US007722477B2

(12) United States Patent
Consiglio

(10) Patent No.: US 7,722,477 B2
(45) **Date of Patent: *May 25, 2010**

(54) IMPACT FORCE DAMPENING SYSTEM FOR USE WITH A GOLF DRIVER OR FAIRWAY CLUB HEAD

(76) Inventor: Joseph Consiglio, 105 Saw Timber Dr., Hilton Head Island, SC (US) 29926

( * ) Notice: Subject to any disclaimer, the term of this patent is extended or adjusted under 35 U.S.C. 154(b) by 114 days.

This patent is subject to a terminal disclaimer.

(21) Appl. No.: 12/047,058

(22) Filed: Mar. 12, 2008

(65) Prior Publication Data

US 2009/0042663 A1 Feb. 12, 2009

Related U.S. Application Data

(63) Continuation-in-part of application No. 11/297,188, filed on Dec. 8, 2005, now Pat. No. 7,396,294.

(51) Int. Cl.
*A63B 53/04* (2006.01)

(52) U.S. Cl. ..... 473/332; 473/340; 473/345

(58) Field of Classification Search ..... 473/324–350
See application file for complete search history.

(56) References Cited

U.S. PATENT DOCUMENTS

| | | | | |
|---|---|---|---|---|
| 863,728 | A * | 8/1907 | Legh | 473/343 |
| 1,396,455 | A * | 11/1921 | Moore | 411/411 |
| 1,627,848 | A * | 5/1927 | Hubbard | 473/343 |
| 3,917,277 | A | 11/1975 | Beck et al. | |
| 4,422,638 | A | 12/1983 | Tucker | |
| 5,458,332 | A | 10/1995 | Fisher | |
| 5,489,097 | A | 2/1996 | Simmons | |
| 5,620,381 | A | 4/1997 | Spalding | |
| 5,643,111 | A | 7/1997 | Igarashi | |
| 5,718,643 | A | 2/1998 | Wright et al. | |
| 5,820,481 | A | 10/1998 | Raudman | |
| 5,910,055 | A * | 6/1999 | Bennett | 473/305 |
| 6,200,226 | B1 | 3/2001 | Regan | |
| 6,450,903 | B1 | 9/2002 | Tate | |
| 6,729,972 | B2 | 5/2004 | Boord | |
| 6,743,117 | B2 | 6/2004 | Gilbert | |

(Continued)

FOREIGN PATENT DOCUMENTS

| | | |
|---|---|---|
| JP | 62075225 | 4/1987 |

(Continued)

*Primary Examiner*—Alvin A Hunter
(74) *Attorney, Agent, or Firm*—Gifford, Krass, Sprinkle, Anderson & Citkowski, P.C.

(57) ABSTRACT

A force dampening and redirection system for use with a golf driver or fairway club head including an elongated handle terminating in a three-dimensional shaped driver or fairway head exhibiting a substantially smooth ball striking face. A vibration dampening and absorbing component, such as an elongated spring, extends within a hollow three dimensional interior associated with the club head. Upon impacting a golf ball offset from a center line associated with the striking face, an off-center striking force is more readily transferred to the spring, both to counteract twisting of the putter head and to reduce vibration of the club face at the ball contact zone, thereby increasing an effective surface area of the striking face creating a perpendicular travel direction of the ball relative to the golf club striking face.

15 Claims, 5 Drawing Sheets

U.S. PATENT DOCUMENTS

| | | | | |
|---|---|---|---|---|
| 6,921,343 | B2 | 7/2005 | Solheim | |
| 7,445,562 | B2 * | 11/2008 | Sano | 473/332 |
| 2005/0014574 | A1 | 1/2005 | Sung | |

FOREIGN PATENT DOCUMENTS

| | | | | |
|---|---|---|---|---|
| JP | 06339551 | | | 12/1994 |
| JP | 08289950 | | | 11/1996 |
| JP | 09024125 | A | * | 1/1997 |
| JP | 09239080 | | | 9/1997 |
| JP | 11042302 | A | * | 2/1999 |
| JP | 11267255 | | | 10/1999 |
| JP | 2000237363 | | | 9/2000 |
| JP | 2004188221 | A | * | 7/2004 |
| WO | WO-9832500 | | | 7/1998 |
| WO | WO-9844997 | | | 10/1998 |

* cited by examiner

Fig-9
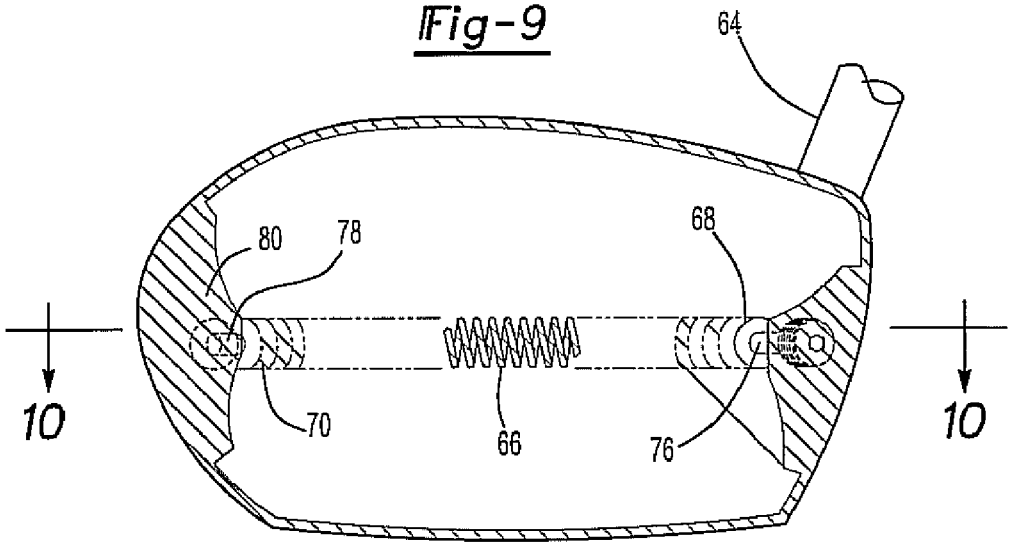
Fig-10
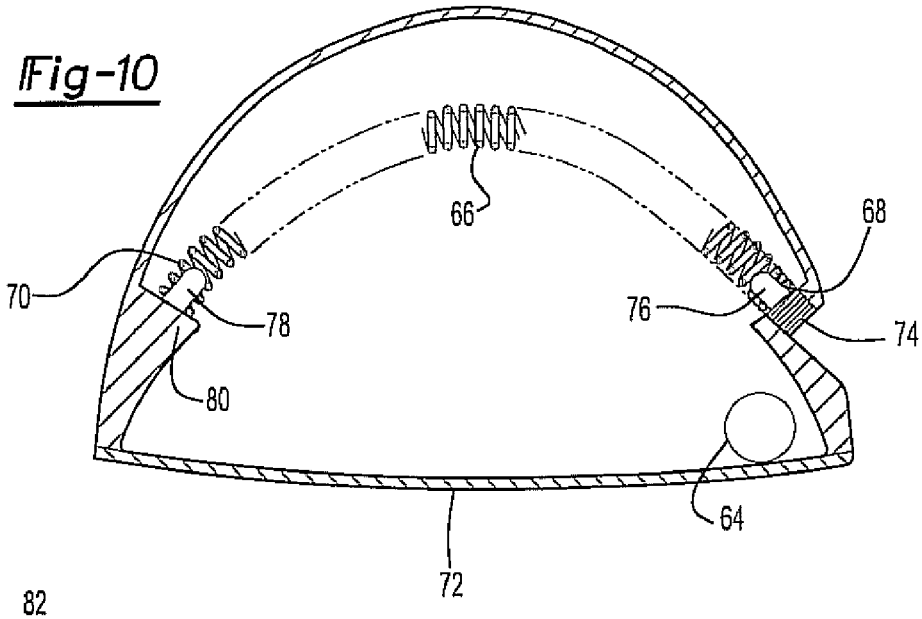
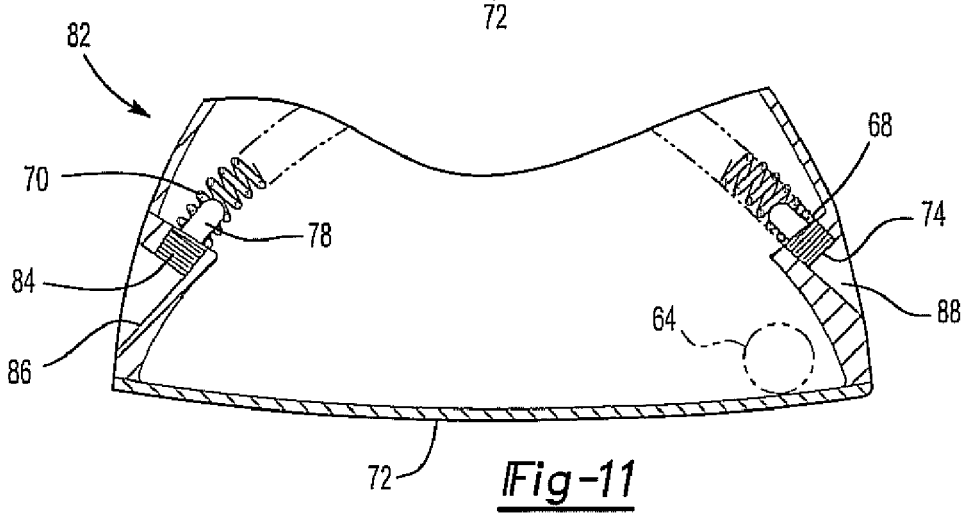
Fig-11

IMPACT FORCE DAMPENING SYSTEM FOR USE WITH A GOLF DRIVER OR FAIRWAY CLUB HEAD

CROSS-REFERENCE TO RELATED APPLICATIONS

This Application is a Continuation-in-part of application Ser. No. 11/297,188 filed on Dec. 8, 2005 for IMPACT FORCE DAMPENING SYSTEM FOR USE WITH A GOLF PUTTER HEAD.

FIELD OF THE INVENTION

The present invention relates generally to golfing clubs and, in particular, golf putters. More specifically, the present invention discloses a force dampening and redirection system for use with a golf driver or fairway club head, incorporating a vibration-inducing component and which, in operation, increases an effective "sweet spot", this historically being the location of center of gravity of the golf club head and which results in straight and maximum travel of the golf ball, associated with the club head striking face providing straight directional travel of a golf ball.

BACKGROUND OF THE INVENTION

The prior art is well documented with examples of golf club putter devices. A major objective of such devices is the ability to transfer, in a substantially lineal and consistent fashion, forces of impact associated with the forward travel of the putter head against a golf ball during a putting stroke.

U.S. Pat. No. 5,620,381, issued to Spalding, teaches a putter incorporating a plurality of line spring wires distributed along its lengthwise extending face and including an angled leg portion, which extends upward and outward away from the initial leg portion. As the putter is swung, the angled leg portions spring inward and then upward and outward due to contact with the golf ball. This spring action simultaneously imparts both a forward and topspin motion to the golf ball, the professed objective being to impart a rolling motion (and as opposed to non-rotative and primarily "scooting" motion) as early on as possible during the putting stroke and in order to provide better direction and control of the ball.

U.S. Pat. No. 5,820,481, issued to Raudman, teaches an improved golf putter employing an elastomeric material between the putter face and body in order to dampen vibrations caused by impact of the moving putter face on the golf ball. Of relevant note, the vibrations are directed by the putter body configuration in such a way as to maximize the dampening function. In order to provide enhanced rolling motion to the struck ball, weighting is focused towards the bottom of the putter head. Angular design of the face, bottom and heel acts to decrease potential blade turf drag, enhancing the smooth feel of the club system.

U.S. Pat. No. 6,743,117, issued to Gilbert, discloses a golf club head having a substantially perimeter weighted club head, including the interposing of three inserts, including among them a striking face insert, a dampening insert, and a back insert. The dampening insert is preferably constructed of a lead alloy, and is interposed between the other inserts to provide for changes in club swing weight, as well as relief for vibration and acoustical variations. The striking face insert is further preferably made from a stainless steel alloy and the back insert from a carbon graphite. Gilbert further discloses the dampening insert being maneuvered into varied positions to effect a change in the specific gravity of each club head of a golf club set.

Another interesting example of a vibrational dampening putter is set forth in WO 98/32500, to Cobra Golf, and which teaches a cavity backed design with three piece construction. A club head body portion includes a strike face insert cavity for receiving a strike face insert, this further exhibiting a central cavity. An additional recess is formed within the strike face insert cavity and may receive a vibration dampening material. The sizes of the strike face insert cavity, vibration dampening insert recess and aperture are progressively varied in accordance with the particular golf club characteristics, in order to improve weight distribution and/or vibration dampening and to increase strike face surface area.

SUMMARY OF THE INVENTION

The present invention discloses a golf club capable of increasing the "sweet spot" associated with the club head striking face, and which results in the imparting of substantially perpendicular and lineal ball travel relative to the striking face. As defined previously, the "sweet spot" of a golf club head is traditionally its center of gravity and, upon striking a ball at this location upon the putter striking face, resultant ball travel is maximized as to both distance and straightness. The present invention utilizes vibration generating/redirecting components associated with the putter head, offsetting the twisting tendencies of the putter head from acting upon a golf ball contacted offset from a mass centerline associated with the putter head.

In a first embodiment, a putter bead includes a semi-circular shaped and coiled spring securing at first and second ends to associated surface locations of the putter head arranged opposite the ball striking face. The spring contacting ends may further be encased within at least one elongated and interiorly hollowed closure secured to the putter head. The closure may likewise be semi-circular shaped or, in the instance of a pair of independent coiled portions, be provided as separate components.

In further related embodiments associated with the putter head, the vibration inducing components are provided by tuning-fork shaped articles secured to each of first and second surface locations of the putter head arranged opposite the ball striking face. Either the miniaturized tuning forks or, alternatively, the spring contacting portions, can be provided in any of in-line, arcuate or angularly offset manner relative to the associated mounting surface of the putter head, and in order to adjust the desired degree of vibration induced dampening associated with a given off centerline location of the club head.

In a further embodiment, the spring dampening physics are incorporated into the three dimensional interior of a driver or fairway club head. This can further include the provision of a spring exhibiting a pseudo elliptical bend, or semi-circular when viewed in an inner cutaway plan illustration, and which is installed at both heel and toe locations so that the spring arcuately extends about a hollow interior of the three dimensional body. Additional mass is located at both the toe and heel locations to more readily transfer an off-center striking force to the spring.

BRIEF DESCRIPTION OF THE DRAWINGS

Reference will now be made to the attached drawings, when read in combination with the following detailed description, wherein like reference numerals refer to like parts throughout the several views, and in which:

FIG. 9 is a frontal cutaway view of the club head shown in FIG. 7;

FIG. 10 is a further cutaway view, taken along line 10-10 of FIG. 9, and showing the configuration of the interiorly supported spring from a top position; and FIG. 11 is a cutaway illustration similar to that shown in FIG. 10, with the exception that a second set screw is substituted for the spring to club toe connection.

DETAILED DESCRIPTION OF THE PREFERRED EMBODIMENTS

Figure 1:
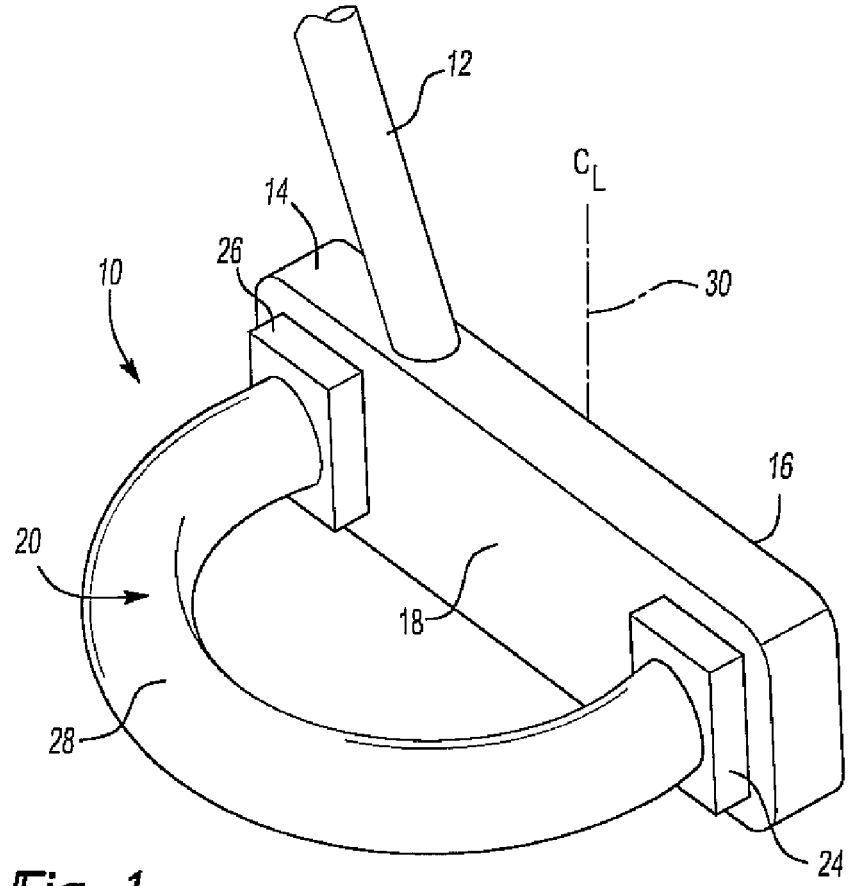
FIG. 1 is a perspective illustration of a golf putter exhibiting force-dampening features according to an embodiment of the present invention.

Referring now to FIG. 1, a perspective illustration is shown at 10 of a golf putter exhibiting impact force dampening and redirection characteristics according to a preferred embodiment of the present invention. In particular, the present invention utilizes vibration generating/redirecting components associated with the putter head, these acting to offset the twisting tendencies of the putter head about its associated center line, to thereby prevent an undesirable angle of direction being imparted upon a golf ball contacted outside of the ideal mass centerline associated with the putter head.

Referring again to FIG. 1, the putter includes an elongated handle 12 terminating in a three-dimensional shaped putter head 14. The putter head 14 is constructed of a wood, metallic or plasticized, such as in particular nylon, material (such material further being understood as capable of transferring the vibrationally induced component through the body of the putter head and to its front face) and typically exhibits a substantially rectangular shape in configuration with a substantially smooth front ball striking face 16 and an opposite rear face 18. It is also envisioned that the putter head 14 can adapt any other desired configuration within the ordinary skill of one in the relevant art.

A vibration inducing component according to the initial embodiment is generally illustrated at 20 and exhibits a semicircular shaped coiled spring element (see at 22 in FIG. 2) and which is secured to first 24 and second 26 surface locations associated with the rear face 18 of the putter head 14. The surface mounting locations 24 and 26 are further evidenced in the illustrated embodiment by three-dimensional shaped supports, these interconnecting the ends of the vibration inducing and arcuate coil spring 22 with the body of the putter head 14. Beyond the manner of interconnecting the spring 22, as illustrated in FIG. 2, it is also understood that any other suitable structure can be employed within the scope of the invention for mechanically and vibrationally communicating the spring 22 (or other suitable vibration inducing component) with the putter striking surface 16.

Figure 2:
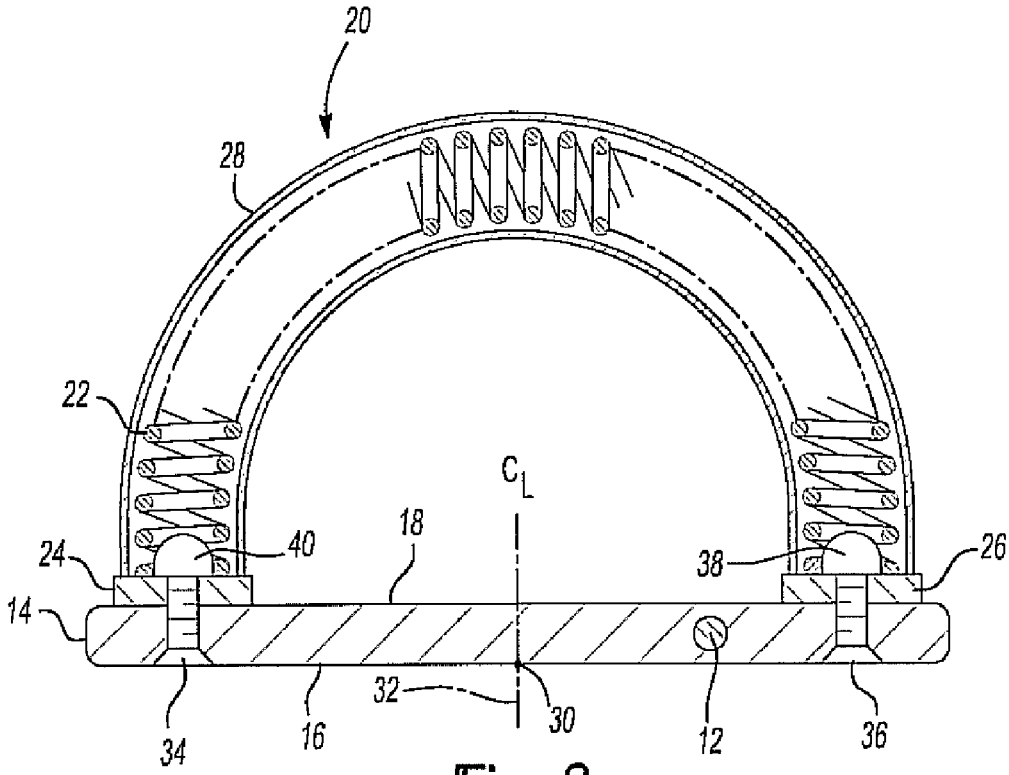
FIG. 2 is a plan cutaway view of the golf putter head and further illustrating the vibration inducing spring component associated with the embodiment of FIG. 1.

Also illustrated in FIGS. 1 and 2 is the provision of a likewise arcuate and elongated (interiorly hollowed) closure 28 secured to the support and enclosing the vibration inducing component. It is understood that, the provision of a suitably configured enclosure 28 is optional and, as with the degree of tension and coil density associated with the spring 22, may be modified to vary the vibrational inducing force applied to the front face 16 of the putter head 14.

Upon impacting a golf ball (not shown) along a center line (see at 30 in each of FIGS. 1 and 2) associated with the front striking face 16, this vertically intersecting a center of mass associated with the putter head 14, the golf ball is caused to travel in a substantially straight direction, corresponding with a perpendicular relative to the putting face 16 and as is referenced at 32 in FIG. 2.

The present invention is intended to address the inevitable non-linear (or more accurately the non-perpendicularly) extending travel of the golf ball, resulting from the striking motion of the putter head against the ball outside of the centerline "sweet spot". In this instance, the inevitable physical rotation of the putter head 14 causes it to rotate about its center of mass (again resulting from the combined physical effect of the putter head's mass and its connection location to the elongated handle 12), imparting an undesirable "push" or "pull" to the ball causing it to travel in a non-linear direction.

The vibration inducing component of the present invention operates to counteract this inevitable twisting of the putter head, through the creation of a vibrational inducing/offsetting component which acts upon the point of contact with a golf ball contacted by the putter head offset from either side of the centerline/center of mass. The mounting of the vibration inducing component, to either end of the putter rear face 18, results in the intensity of the vibrational created component increasing as a variable of the lateral distance from the centerline location 30, thereby increasing an effective surface area of the striking face by which a desired perpendicular travel direction of the ball relative to the putting face is maintained. The purpose of the vibrational inducing components is to collect and redirect the impact forces associated with a non-centerline striking of a golf ball by the putting face (not the creation or new or additional forces) to "correct" inevitable rotation of the putting head about its mass center and to again thereby increase the surface area (sweet spot) of the putter striking face achieving substantially perpendicular directed motion of the ball.

Additional features associated with the disclosed embodiment 10 include the provision of aligning and interiorly threaded apertures associated with the putter head 14 and each of the supports 24 and 26 (see in particular FIG. 2). A pair of mounting screws 34 and 36 secure the supports 24 and 26 to the edge locations of the forward ball striking face 16, whereas spring mounting knobs 38 and 40 (again FIG. 2) which structurally secure the spring and associated housing to the rear side of the putter head, thereby structurally and (vibrationally) interconnected the inducing component 22 through the putter head and across its front lace 16.

As is illustrated in FIG. 2, the recesses defined in the forward facing surface of the putter head may be dovetailed to provide a flush end appearance to the screw heads, however it is further understood that any suitable means for securing the vibration inducing component to the desired locations of the putter head is also contemplated, such further including the provision of welding, adhesives or the like. It is also envisioned that, while the preferred embodiment contemplates the mounting locations of the semi-circular spring 22 as corresponding to the rear face of the putter head 14, it is further envisioned that the vibration inducing components can be mounted in alternate locations, provided that the required degree and direction of the vibrational generated force is established for acting upon the golf ball.

Figure 3:
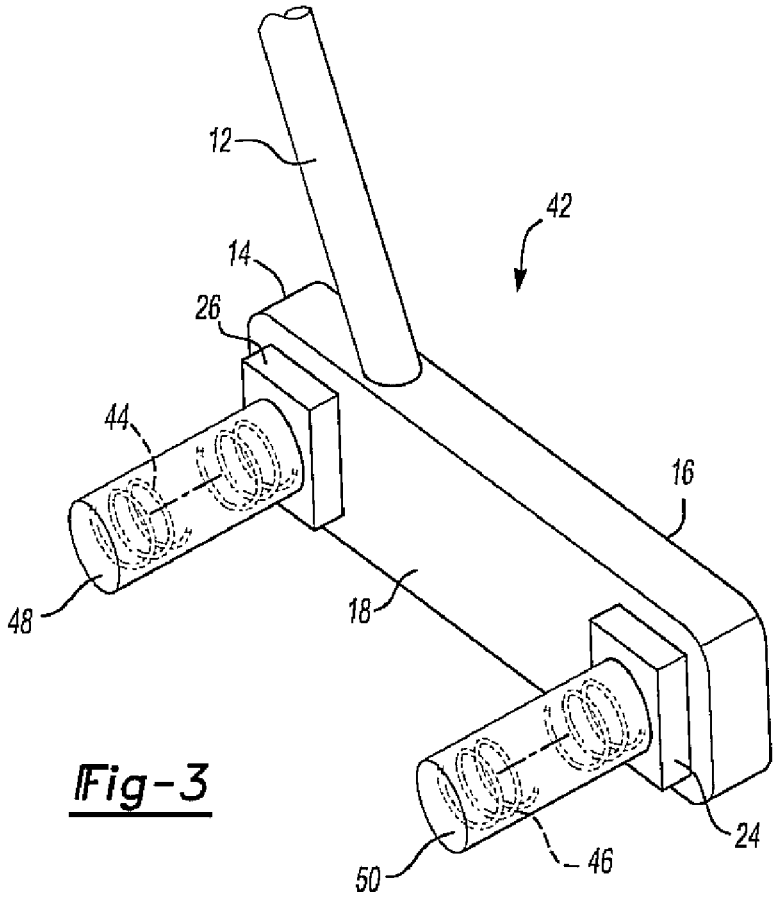
FIG. 3 is a perspective illustration of a golf putter head, and illustrating a pair of individual vibration inducing components secured to the putter head according to a further embodiment of the present invention.
Figure 4:
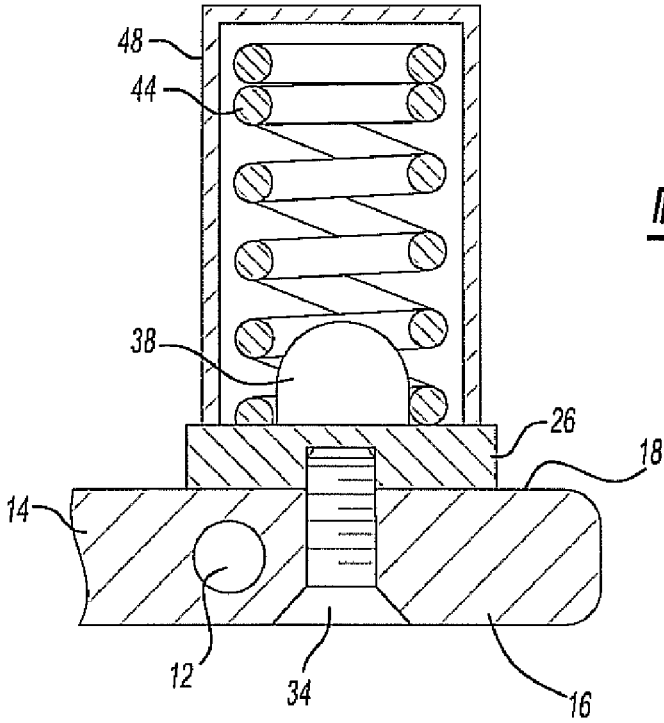
FIG. 4 is a cutaway view of a selected vibration-inducing component illustrated in FIG. 3.

Referring now to FIG. 3, a perspective illustration 42 of a golf putter head is shown according to a further embodiment. Common features associated with the putter handle and head are repeated from FIGS. 1 and 2, the embodiment 42 further including a pair of individual vibration inducing components in the form of individual and substantially linear (rearwardly) extending springs 44 and 46 secured to the putter head. As with the previously described embodiment 10, the springs 44 and 46 each secure to respective rearward mounted supports 24 and 26 in order to impart a desired compensating level of vibrationally induced and redirecting force. As is also referenced by the cutaway view of FIG. 4, each vibration-inducing component, illustrated as spring component 44, may also, and optionally, include an elongated and interiorly hollowed closure, such as illustrated at 48 for spring inducing component 44 as well as at 50 for spring inducing component 46.

Figure 5:
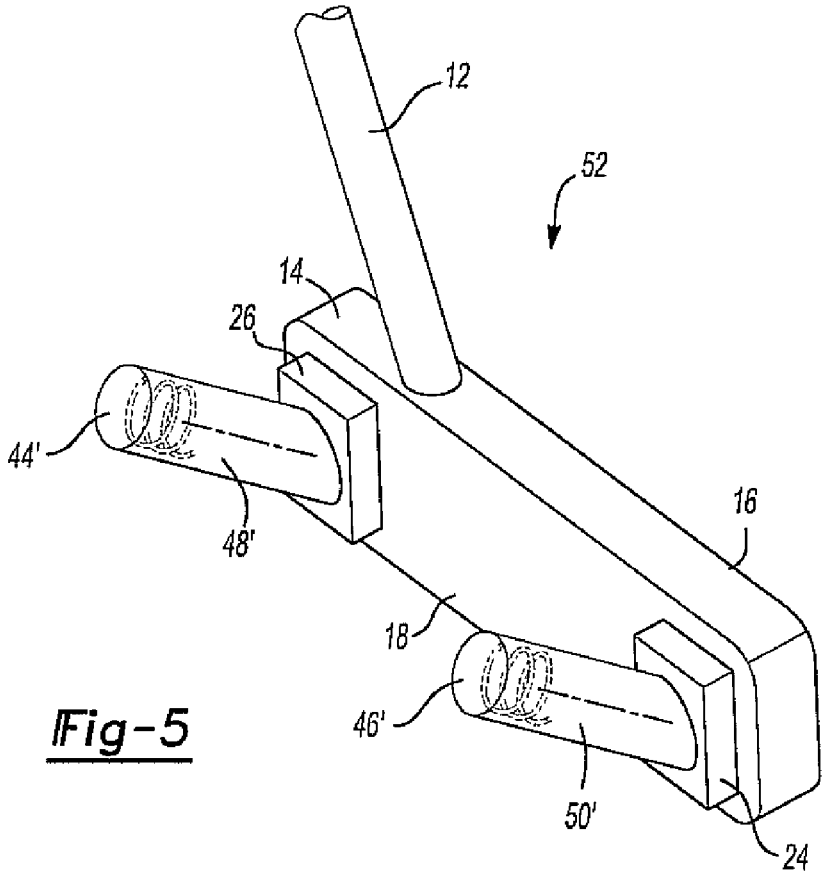
FIG. 5 is a perspective illustration of a golf putter head, similar to that illustrated in FIG. 3, and according to a still further embodiment exhibiting an angular orientation associated with each of the individually secured vibration inducing components.

FIG. 5 is a perspective illustration 52 of a golf putter head, similar to that illustrated in FIG. 3, and according to a still further embodiment. Of note, the embodiment of FIG. 5 exhibits an angular orientation associated with each of the individually secured vibration inducing components, i.e., vibrational inducing springs shown at 44' and 46' and including likewise angularly oriented enclosures 48' and 50' respectively. FIG. 5 illustrates the manner by which the vibration inducing and redirecting components can be arranged in any of arcuate, in-line or angular extending fashion as set forth in the preceding embodiments within the scope of the invention.

Figure 6:
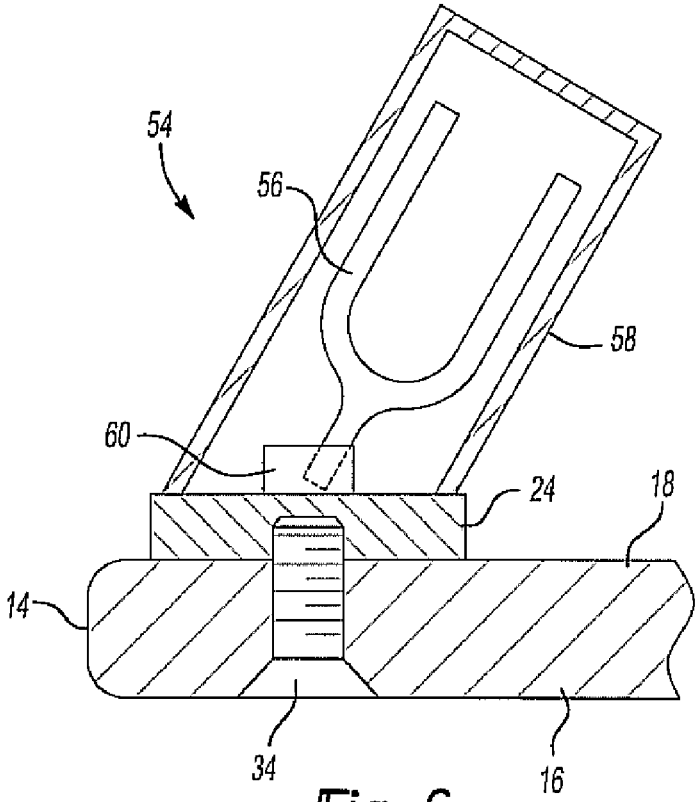
FIG. 6 is an illustration similar to that shown in FIG. 4, and showing a selected vibration inducing component according to a yet further embodiment according to the present invention.

Referring to FIG. 6, a sectional illustration 54 is shown of a selected vibrational inducing component according to a yet further embodiment and which illustrates a tuning-fork shaped article 56 secured to the selected surface locations of the putter head arranged opposite the ball striking face. The illustration of the tuning fork article stresses that any suitable vibration inducing article may be incorporated into the golf putter design within the scope of the invention.

As with the previously disclosed embodiments, the vibration inducing component 56 may, optionally, be enclosed by a suitable enclosure 58 and is in structural (and thereby vibrational) communication with the front face 16 of the putter head. Reference is further made to mounting base 60 for securing the tuning fork 56 (with or without separately secured enclosure 58) to the rear face secured support 24, and to thereby provide the desired vibrational inducing characteristics as previously described.

Figure 7:
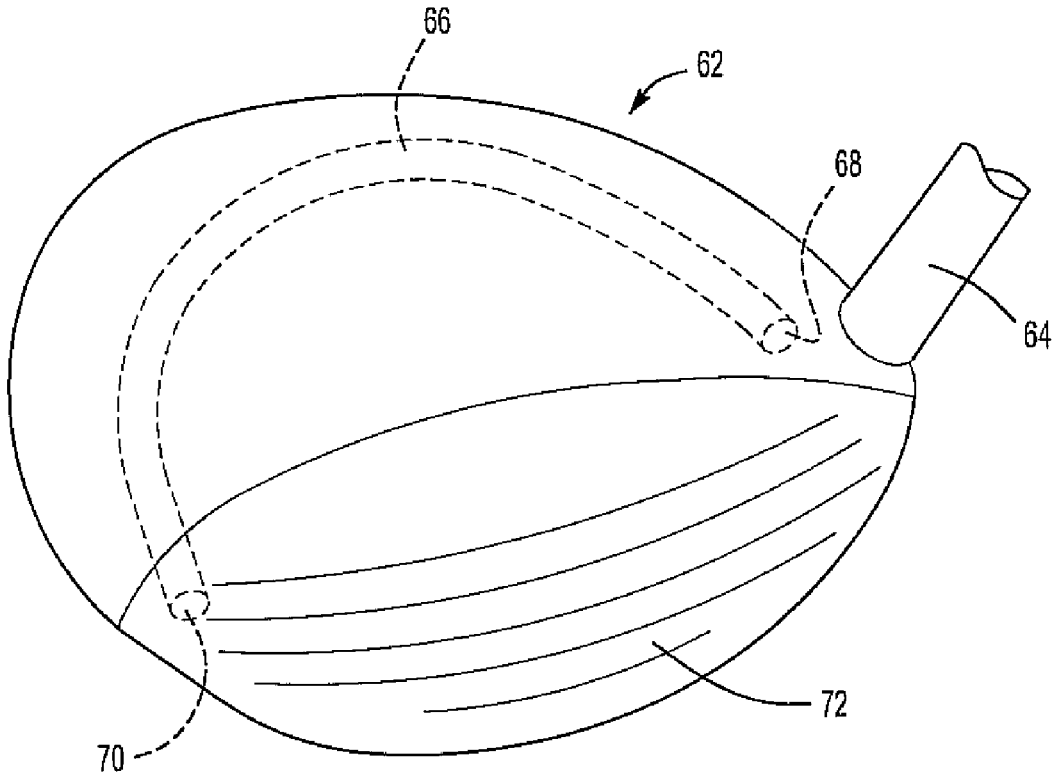
FIG. 7 is a perspective illustration of an impact force dampening system incorporated into a hollow three dimensional interior associated with a driver or fairway club.

Referring now to FIG. 7, a perspective illustration is generally shown at 62 of an impact force dampening system incorporated into a hollow three dimensional interior associated with a driver or fairway club head. An elongated handle is shown at 64 and connects to a generally heel location of the head 62, and which further can incorporate any desired material construction (such as again metal, wood or plasticized composition) consistent with known driver or fairway club head designs.

A generally elongated and pseudo elliptical or semi-circle shaped spring dampening coil is illustrated in phantom at 66 and includes a first heel mounting end 68 and a second toe mounting end 70. As further shown in FIG. 7, the club head incorporates a frontal and substantially planar ball striking face 72 (such as also possible including an integrally formed nylon surface), with the spring dampening coil 66 extending in an opposite and generally inwardly spaced fashion relative to the depth extending contour of club head, with the heel and toe mounting locations being disposed in spaced fashion relative to the front lace 72 of the club.

Figure 8:
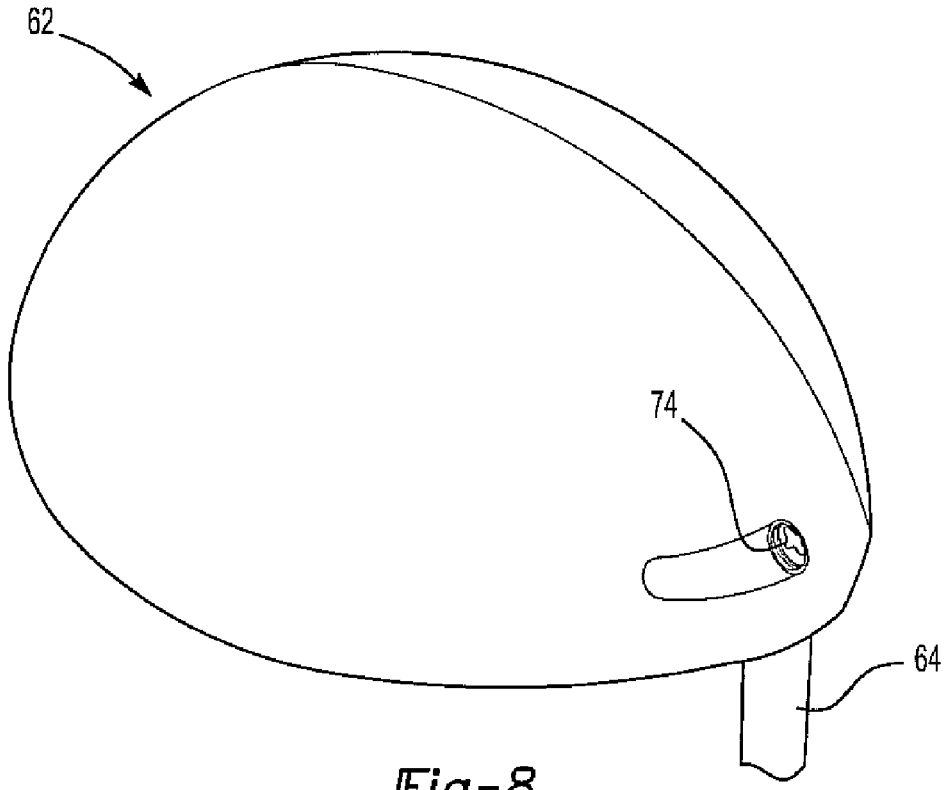
FIG. 8 is a rotated rear view of the club head illustrated in FIG. 7 and showing a set screw for attaching the spring at the heel end of the club.

As further shown in FIG. 8, as well as each of the succeeding cutaway views of FIGS. 9 and 10, a specially constructed manufacturing set screw 74 is provided for attaching the associated heel end 68 of the spring 66 to the heel of the club 62. The set screw 74 exhibits a plurality of threads and which rotatably inter-engage with additional threads formed interiorly with a seating aperture associated with the club head (see again as best shown in FIG. 10). The associated end 68 of the spring 66 is support by a rounded edge projection 76 which is integrally formed with the set screw 74 and insertingly seats through the end 68 of the spring. A further rounded edge projection is shown at 78 and, in the embodiment of FIGS. 7-10, is supported upon an inner facing shelf 80 defining a fixed toe mounting end of the club head.

Additionally, the spring can be welded or set with a permanent type adhesive. It is also most evident in FIG. 10 that the spring 66 can exhibit an overall "pseudo" or half elliptical/circular configuration. Furthermore, the additional mass located at both the heel and toe ends of the club head interior, as best shown in the interior cutaway views of FIGS. 9 and 10, translate into a better capability of an off-center striking force applied to the club face 72 being more readily and evenly transferred to the spring 66 (e.g. resulting in more complete vibration dampening).

Referring finally to FIG. 11, a cutaway illustration is shown generally at 82, which is similar in most respects to that shown in FIG. 10, with the exception that a second special manufacturing set screw 84 is substituted for the spring to club toe connection and which likewise seats within associated and inwardly facing threads for providing an additional degree of toe end compressive load retention. The reconfigured toe end of the club head (as shown at 86) includes an angled entry passageway which substitutes for the fixed inner shelf 80 of FIG. 10. This is similar to a lead in passageway also referenced at 88 and associated with the heel end set screw again shown at 74.

It is therefore evident that the present invention discloses a novel and useful force dampening and redirection system for use with such as a golf driver or fairway club head, incorporating a vibration-inducing component and which, in operation, increases an effective "sweet spot", this historically being the location of center of gravity of the golf club head. In practice, this results in straight and maximum travel of the golf ball, associated with the club head striking face, thereby providing straight directional travel of a golf ball. In the instance of spring inducing elements, their respective length and wire diameter, as well as again their number of coils, can be modified to provide a different range of vibrational input (or feel to the user) during the club contact. It is also envisioned that a single or plural number of springs can be utilized in any effective manner consistent with the teachings of the present disclosure.

Having described my invention, additional preferred embodiments will become apparent to those skilled in the art to which it pertains, and without deviating from the scope of the appended claims.

I claim:

1. A golf club exhibiting impact force dampening and ball directional characteristics upon impacting a golf ball, comprising:

an elongated handle terminating in a three-dimensional shaped club head exhibiting a substantially smooth ball striking face with heel and toe mounting locations being disposed in spaced fashion relative to said ball striking face;

a vibration inducing coiled spring exhibiting a half elliptical or circular shape and extending within an open interior of said club head between the heel and toe and in an opposite and generally inwardly spaced fashion relative to a depth extending contour of said club head;

at least one special manufacturing set screw for mounting said vibration inducing spring at a selected one of the heel and toe locations; and upon impacting the golf ball, said vibration inducing spring responding to an off-center force applied to the ball striking face to increase an effective surface area of said striking face associated with straight travel of the ball.

2. The golf club as described in claim 1, further comprising a pair of special manufacturing set screws at the heel and toe locations.

3. The golf club as described in claim 1, further comprising an associated end of said vibration inducing component being support by a rounded or special thread edge projection which is integrally formed with said set screw and insertingly seats through an end of said vibration inducing component.

4. The golf club as described in claim 1, further comprising a rounded or threaded edge projection supported upon an inner facing shelf defining a fixed toe mounting end of said club head.

5. The golf club as described in claim 1, said club head having a specified shape and size and further comprising at least one of a metallic, wood, and a plasticized material.

6. The golf club as described in claim 1, said ball striking face having a specified shape and size and further comprising an optional integral nylon surface.

7. A golf club exhibiting impact force dampening and ball redirection characteristics upon impacting a golf ball, comprising:

an elongated handle terminating in a three-dimensional shaped club head exhibiting a substantially smooth bail striking face with heel and toe mounting locations being disposed in spaced fashion relative to said ball striking face;

a vibration inducing and elongated coiled spring extending within an open interior of said club head and mounted to first and second end locations inwardly spaced from said ball striking face;

at least one manufacturing set screw for mounting said vibration inducing spring at a selected one of the heel and toe locations, a pair of special manufacturing set screws at the heel and toe locations; and upon impacting the golf ball, said vibration inducing spring responding to an off-center force applied to the bail striking face to increase an effective surface area of said striking face associated with straight travel of the ball.

8. The golf club as described in claim 7, said coiled spring exhibiting a half elliptical/circular shape and extending in an opposite and generally inwardly spaced fashion relative to said ball striking face.

9. The golf club as described in claim 7, further comprising an associated end of said spring being support by a rounded or threaded edge projection which is integrally formed with said set screw and insertingly seats through an end of said spring.

10. The gaff club as described in claim 7, further comprising a rounded edge or thread projection supported upon an inner facing shelf defining a fixed toe mounting end of said club head.

11. The gaff club as described in claim 7, said club head having a specified shape and size and further comprising at least one of a metallic, wood, and a plasticized material.

12. The golf club as described in claim 7 said ball striking face having a specified shape and size and further comprising an optional integral nylon surface.

13. A golf club exhibiting impact force dampening and ball redirection characteristics upon impacting a gaff ball, comprising:

an elongated handle terminating in a three-dimensional shaped club head exhibiting a substantially smooth ball striking face with heel and toe mounting locations being disposed in spaced fashion relative to said ball striking face;

a vibration inducing and elongated spring extending within an open interior of said club head and mounted to first and second end locations inwardly spaced from said ball striking face;

at least one manufacturing set screw for mounting said vibration inducing component at a selected one of the heel and toe locations; and upon impacting the golf ball, said spring responding to an off-center force applied to the ball striking face to increase an effective surface area of said striking face associated with straight travel of the ball.

14. The golf club as described in claim 13, said spring exhibiting a half elliptical/circular shape and extending in an opposite and generally inwardly spaced fashion relative to said ball striking face.

15. The golf club as described in claim 13, further comprising a pair of special manufacturing set screws at the heel and toe locations.

* * * * *

UNITED STATES PATENT AND TRADEMARK OFFICE

CERTIFICATE OF CORRECTION

PATENT NO. : 7,722,477 B2
APPLICATION NO. : 12/047058
DATED : May 25, 2010
INVENTOR(S) : Joseph Consiglio It is certified that error appears in the above-identified patent and that said Letters Patent is hereby corrected as shown below:

Column 8, line 2, replace “bail” with --ball--

Column 8, line 13, replace “gaff” with --golf--

Column 8, line 17, replace “gaff” with --golf--

Column 8, line 24, replace “gaff” with --golf--

Signed and Sealed this
Eighth Day of March, 2011

David J. Kappos
*Director of the United States Patent and Trademark Office*